US011173412B2

(12) United States Patent
Hansen et al.

(10) Patent No.: US 11,173,412 B2
(45) Date of Patent: Nov. 16, 2021

(54) TOY CONSTRUCTION ELEMENT

(71) Applicant: LEGO A/S, Billund (DK)

(72) Inventors: Julie Sommer Hansen, Billund (DK); Anders Merrild Kristensen, Billund (DK); Klaus Sabroe, Billund (DK); Johan Dybvad Larsen, Billund (DK); Lukas Brza, Billund (DK); Alba Suárez Zapico, Billund (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 16/955,867

(22) PCT Filed: Jan. 10, 2019

(86) PCT No.: PCT/EP2019/050541
§ 371 (c)(1),
(2) Date: Jun. 19, 2020

(87) PCT Pub. No.: WO2019/137996
PCT Pub. Date: Jul. 18, 2019

(65) Prior Publication Data

US 2020/0330895 A1 Oct. 22, 2020

(30) Foreign Application Priority Data

Jan. 11, 2018 (DK) ..... PA 2018-70018

(51) Int. Cl.
*A63H 33/00* (2006.01)
*A63H 33/08* (2006.01)
(Continued)

(52) U.S. Cl.
CPC ..... *A63H 33/086* (2013.01); *A63H 33/107* (2013.01); *A63H 33/044* (2013.01)

(58) Field of Classification Search
CPC ..... A63H 3/52; A63H 33/04; A63H 33/044; A63H 33/086; A63H 33/107
(Continued)

(56) References Cited

U.S. PATENT DOCUMENTS 4,103,774 A * 8/1978 Shingyouchi ..... A45C 1/12 206/45.2
4,378,117 A * 3/1983 Rubik ..... A63F 9/0834 273/153 S
(Continued)

FOREIGN PATENT DOCUMENTS

CN 1568213 A 1/2005
CN 202765662 U 3/2013
(Continued)

OTHER PUBLICATIONS

Search Report in Priority Danish Application No. PA 2018 70018, dated May 22, 2018.
(Continued)

*Primary Examiner* — Alexander R Niconovich
(74) *Attorney, Agent, or Firm* — Day Pitney LLP; Valeriya Svystun

(57) ABSTRACT

A bowl shaped toy construction element where two such elements can be assembled via releasable and pivotable hinge connections with a hinge axis, and where the hinge axes defined by the first and the second type of protruding connecting parts are mutually parallel and defining a first plane, and where the bowl shaped elements has a stand surface extending in a second plane substantially perpendicular to the first plane.

11 Claims, 2 Drawing Sheets

(51) Int. Cl.
*A63H 33/10* (2006.01)
*A63H 33/04* (2006.01)

(58) Field of Classification Search
USPC ..... 446/73, 75, 120, 124, 128, 85, 102, 104
See application file for complete search history.

(56) References Cited

U.S. PATENT DOCUMENTS 4,446,649 A * 5/1984 Moe ..... A63H 33/04 446/128
4,606,732 A * 8/1986 Lyman ..... A63H 33/086 446/104
4,789,369 A * 12/1988 Lyman ..... A63H 33/042 446/101
4,822,314 A * 4/1989 O'Brian ..... A63H 33/04 206/216
5,035,324 A * 7/1991 Bertrand ..... B65D 81/365 206/457
5,209,693 A * 5/1993 Lyman ..... A63H 33/042 403/157
5,380,232 A * 1/1995 Berggreen ..... A63H 17/26 446/75
5,727,983 A * 3/1998 Koldste ..... A63H 33/042 446/428
6,301,747 B1 * 10/2001 Parein ..... A63H 33/062 16/260
7,118,442 B2 * 10/2006 Laliberte ..... A63H 33/06 446/85
7,285,034 B2 * 10/2007 Kay ..... A63H 3/52 446/487
7,654,531 B2 * 2/2010 Collins ..... A63F 3/0023 273/287
2006/0079355 A1 * 4/2006 May ..... A63B 43/00 473/594
2007/0086607 A1 * 4/2007 Holsheimer ..... A63H 33/086 381/172
2012/0108138 A1 * 5/2012 Walterscheid ..... A63H 3/50 446/73
2017/0259182 A1 * 9/2017 Yang ..... A63H 18/04
2020/0330895 A1 * 10/2020 Hansen ..... A63H 33/086

FOREIGN PATENT DOCUMENTS

CN 203342371 U 12/2013
GB 664998 A 1/1952
TW 201343488 11/2013
WO 1998030808 A1 7/1998
WO 2001/017634 A1 3/2001
WO 2001017634 A1 3/2001

OTHER PUBLICATIONS

International Search Report issued in corresponding international application No. PCT/EP2019/050541, dated Mar. 28, 2019. (3 pp).
Written Opinion of the International Searching Authority issued in corresponding international application No. PCT/EP2019/050541, dated Mar. 28, 2019. (6 pp).
International Preliminary Report on Patentability, Response to the Written Opinion, with amended sheets of specification and claims, in corresponding international application No. PCT/EP2019/050541, dated Dec. 13, 2019 (28 pp).
Office Action issued in corresponding Chinese patent application No. 201980007487.7, dated Jun. 11, 2021, 8 pages.

* cited by examiner

TOY CONSTRUCTION ELEMENT

CROSS-REFERENCE TO RELATED APPLICATIONS

This application is a U.S. National Stage of International Application No. PCT/EP2019/050541, filed on Jan. 10, 2019 and published on Jul. 18, 2019, as WO 2019/137996 A1, which claims the benefit of priority to Danish Patent Application No. PA 2018 70018, filed on Jan. 11, 2018. The content of each of the above referenced patent applications is incorporated herein by reference in its entirety for any purpose whatsoever.

The present invention relates to a toy construction element comprising a bowl shaped shell part having a peripheral rim surface, an inner face, a stand surface adapted for allowing the shell part to rest on a plane surface, and a first and a second type of protruding connecting parts, and where the shell part is adapted such that two identical shell parts can be assembled by interconnecting the first type of protruding connecting parts on each shell part to the second type of protruding connecting parts on the other shell part, and so that their peripheral rim surfaces are mutually facing each other to form a substantially closed capsule with the inner faces enclosing an inner volume.

DESCRIPTION OF RELATED ART

Toys comprising such semi spherical shell parts to be coupled together as to form a capsule are known in prior art.

WO patent application No. 01/17634 discloses a container for a toy building set comprising toy building elements, said container comprising a bottom part and a lid part that can be interconnected whereby a cavity is formed between the bottom part and the lid part. The bottom part is provided with upwardly extending side walls, and the container is fully closed when the bottom part and the lid part are interconnected. The container is provided with coupling means on its inside, said coupling means being complementary with the coupling means of the toy building elements.

However, in many cases it is desirable to further increase the scope of variations for playing options.

SUMMARY OF THE INVENTION

It is therefore an object of the present invention to provide a toy construction element that provides several options and thus increase the variety of options.

This is achieved by having the first type of protruding connecting part and the second type of protruding connecting part being positioned adjacent the peripheral rim surface at opposite sides, and in that the opposed each other, and where each of the first type of protruding connecting part and the second type of protruding connecting part are adapted to form a releasable and pivotable hinge connection with a hinge axis, and where the hinge axes defined by the first and the second type of protruding connecting parts are mutually parallel and defining a first plane, and where the stand surface extends in a second plane substantially perpendicular to the first plane.

Hereby is achieved, that an arbitrary number of the toy shell elements can be interconnected as to form a continuous row of toy shell elements, such as to imitate a plurality of cavities or compartments such as a playhouse or mini city. Additionally, two toy construction elements can be interconnected to form a capsule comprising an inner enclosed volume.

A user may deconstruct such a previously built spatial structure and re-use the toy construction elements so as to create new spatial structures and configurations.

In a preferred embodiment the first type of protruding connecting part comprises a first cylindrical shaped protrusion comprising a thru hole, the thru hole extends parallel with the first plane and perpendicular to the second plane.

The second type of protruding connecting part may advantageously comprise an upper and a lower cylindrical shaped protrusion each comprising a thru hole, and the two thru holes may furthermore be positioned coaxially extending in a plane parallel with the first plane.

In a further preferred embodiment the upper and the lower cylindrical shaped protrusions are positioned apart from each other along the peripheral rim surface in a distance correspond to the size of the first cylindrical shape protrusion or larger, such that the first cylindrical protrusion is adapted to be fixed between the upper and lower cylindrical shaped protrusions in an releasably and pivotably manner.

Furthermore the thru hole of the first cylindrical shaped protrusion and the thru holes of the upper and the lower cylindrical shaped protrusions may advantageously comprise the same cylindrical shape and cross sectional diameter, so that the the thru holes are adapted to allow a stud shaped toy construction element to be passed through the thru holes to form a common rotation axis.

In a further preferred embodiment the toy construction element comprises a latch pin or a stud-shaped toy construction element, which are adapted to be positioned through three successively positioned thru holes, allowing two or more/adjacent toy construction elements to be pivotally connected.

The toy construction element may also comprise a detachable capsule divider, the capsule divider comprises a hinge portion, which is connected to the shell part.

This aspect may, by the way, be benefited from independently of the features defined in the characterizing portion of claim 1.

In this relation the hinge portion may advantageously be arranged along the peripheral rim surface at a bottom face of the inner surface, and the hinge portion adapted to allow the capsule divider to be moved in use condition from an substantially horizontal open position to a substantially vertical closed position within the inner volume defined by the inner surface of the toy construction element.

In a further preferred embodiment the toy construction element comprises protruding coupling organs and complementary coupling organs allowing the toy construction elements to be interconnected with different types of toy construction elements comprising coupling organs, the protruding coupling organs and complementary coupling organs being positioned on the outer surface or/and the inner surface of the toy construction element.

Furthermore the toy construction element is preferably made from plastic material.

Two or more construction elements may advantageously form part of a toy construction system comprising a plurality of toy construction elements, where each toy construction elements comprises coupling organs for detachable interconnecting the toy construction elements.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

The present invention relates to a toy construction element 1.

Figure 1:
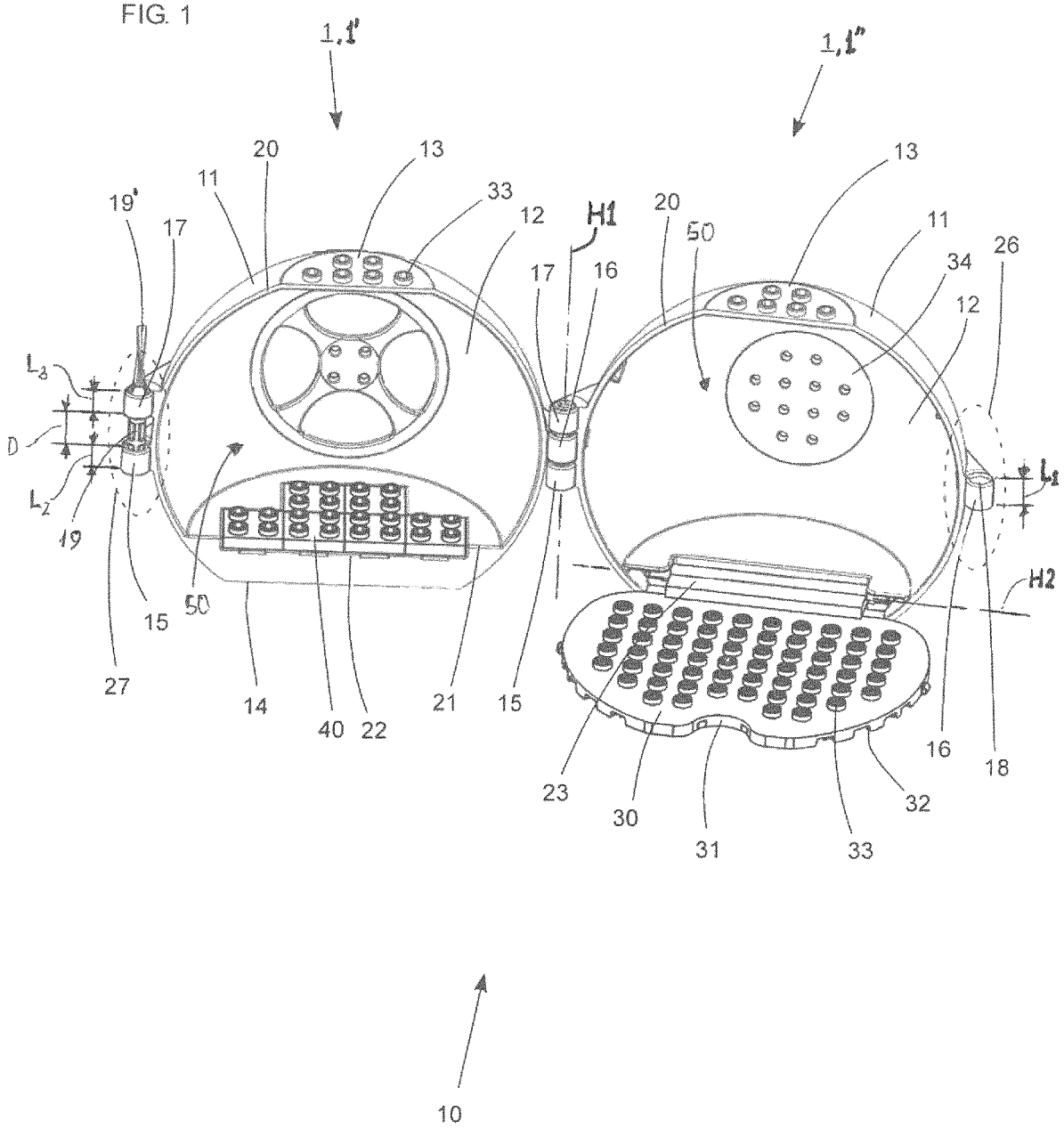
FIG. 1, in a perspective view, shows of a capsule comprising two toy construction elements according to the present invention, FIG. 2, in a perspective view, shows a row of interconnected toy construction elements.
Figure 2:
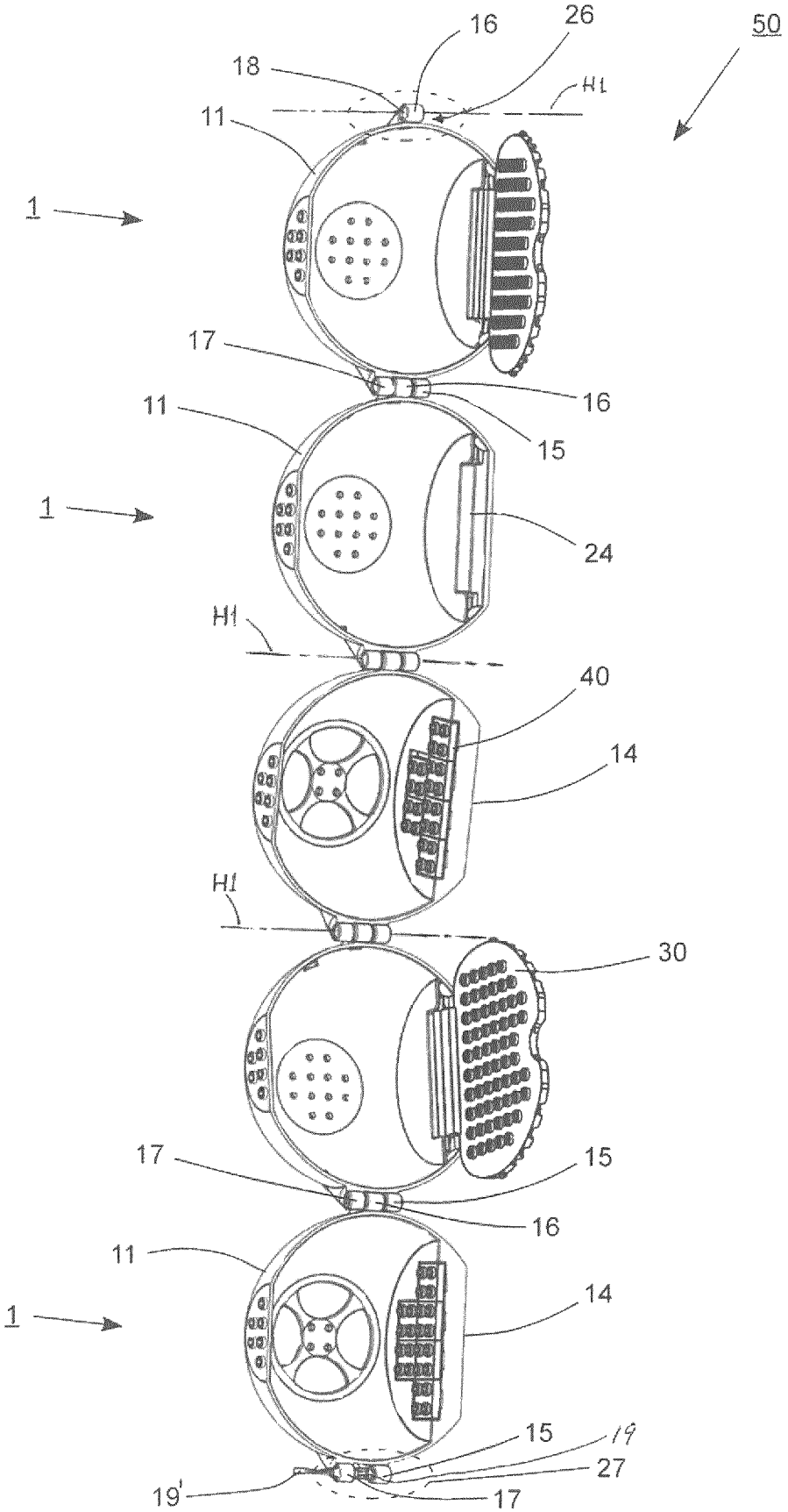

FIGS. 1-2 show views of two different configurations comprising the toy construction element 1.

FIG. 1, in a perspective view, an open capsule 10 comprising two toy construction elements 1 comprising shell parts 11.

The shell part 11 comprises an inner face 12, a stand surface 14 and peripheral rim surface 20 and two protruding connecting parts 26, 27.

The stand surface 14 is adapted to allow the toy construction element 1 to stand, having the peripheral rim surface 20 in a substantially vertical orientation, such that when the toy construction element 1 is placed on a horizontal surface, such as a top surface of a table or a floor, with the stand surface 14 facing the horizontal surface, a plane—first plane—defined by the peripheral rim surface 20 is oriented substantially transversely to the horizontal plane, i.e vertically.

The peripheral rim surface 20 comprises a planar and substantially circular shape, and the peripheral rim surface 20 extends in a first plane. In use condition, when the toy construction element 1 is placed on a horizontal surface with the stand facing the horizontal surface, the first plane extends substantially in a vertical direction at the front face of the peripheral rim surface 20. The peripheral rim surface 20 of one, first construction element 1', is adapted to be positioned juxtaposed a peripheral rim surface 20 of another, second toy construction element 1", such that the two shell parts 11 comprising two abutting peripheral rim surfaces 20 forms a closed capsule 10. A capsule 10 is not shown in the closed state in the figures. In FIG. 1 however, a capsule 10 comprising a first toy construction element 1, 1', and a second toy construction element 1, 1" is shown in an open state, where the peripheral rim surfaces 20 of the first and second toy construction elements 1', 1" are pivoted away from each other around a joint comprised by two protruding connecting parts 26, 27 as described in further detail below.

The shell part 11 comprises a bowl shape. The inner face 12 of the bowl shaped shell part 11 defines a cavity 50. The inner face 12 of the bowl shaped shell part 11 thereby partly encloses an inner volume.

The shell parts 11 are adapted such that two shell parts 11 are coupled together by having the peripheral rim surfaces 20 abutting form a capsule 10 enclosing the inner volumes. The inner volume is formed by the cavities in the two cooperating toy construction elements 1', 1".

The stand surface 14 is adapted to allow the shell part 11 to stand on a substantially planar surface. The stand surface 14 extends in a second plane. In use condition, the second plane extends in substantially horizontal direction.

The second plane extends perpendicular to the first plane.

The toy constriction elements 1 each comprises two protruding connecting parts 26, 27. A first type of protruding connecting part 26 is arranged at a first position adjacent the peripheral rim surface 20, and a second—complementary shaped—protruding connecting part 27 is arranged in a second position adjacent the peripheral rim surface 20.

The first type of protruding connecting part 26 and the second protruding connecting part 27 are positioned adjacent the peripheral rim surface opposed each other. The first type of protruding connecting part 26 and the second type of protruding connecting part 27 comprises a shape adapted such that the first and the second protruding connecting parts on two juxtaposed toy construction elements 1 may be releasable connected to form a pivotably connection.

The interconnection of the first and second type of protruding connecting parts 26, 27 allow both a hinged interconnection and a locking connection, thus allowing the user to create the two different types of configurations shown in FIGS. 1 and 2.

The first type of protruding connecting part 26 comprises a first cylindrical shaped protrusion 16 comprising a thru hole 18, the thru hole 18 extends parallel with the first plane and perpendicular to the second plane. The first cylindrical shaped protrusion 16 has a longitudinal direction coinciding with a longitudinal axis of the thru hole 18. The first cylindrical shaped protrusion 16 has a first length $L_{16}$ in the longitudinal direction. The thru hole 18 preferably is cylindrical, and has an inner diameter.

The second type of protruding connecting part 27 comprises an upper, or second, and a lower, or third, cylindrical shaped protrusion 15, 17 each comprising a thru hole 18. These two thru holes are positioned coaxially extending in a plane parallel with the first plane and perpendicular to the second plane. The second cylindrical shaped protrusion 15 of the second type of protruding connecting part 27 has a longitudinal direction coinciding with a longitudinal axis of the thru hole 18. The second cylindrical shaped protrusion 15 has a second length $L_{15}$ in the longitudinal direction. The thru hole 18 of the second cylindrical shaped protrusion 15 preferably is cylindrical, and has an inner diameter which may be equal to that of the thru hole of the first cylindrical shaped protrusion 16. The third cylindrical shaped protrusion 17 of the second type of protruding connecting part 27 has a longitudinal direction coinciding with a longitudinal axis of the thru hole 18. The third cylindrical shaped protrusion 17 has a third length $L_{17}$ in the longitudinal direction. The thru hole 18 of the third cylindrical shaped protrusion 17 preferably is cylindrical, and has an inner diameter which may be equal to that of the thru hole of the first cylindrical shaped protrusion 16. The second and the third cylindrical shaped protrusion 15, 17 are spaced apart from each other in the longitudinal direction coinciding with a longitudinal axis of the thru hole 18 (along a portion of the peripheral rim surface 20 at a distance D. The length of the first cylindrical shaped protrusion $L_{16}$ corresponds to the distance D, such that a first cylindrical shaped protrusion 16 of one toy construction element 1' may fit between a second cylindrical shaped protrusion 15 and third cylindrical shaped protrusion 17 of a second toy construction element 1", as shown in FIG. 1. In an embodiment the second length $L_{15}$ is equal to the third length $L_{17}$. In an embodiment the first length $L_{16}$ is equal to the second length L15 and the third length $L_{17}$.

The first and second type of protruding connecting parts 26, 27 are positioned adjacent the perimeter rim surface 20 at the same distance from the second plane. Thereby the protruding connecting parts can be interconnected to protruding connecting parts on an adjacent positioned toy construction element 1.

The longitudinal axes of the thru holes 18 of the first second and third cylindrical shaped protrusions 16, 15, 17 thereb may define a hinge axis H.

The peripheral rim surface 20 extends in a first plane defined by the hinge axes H of the first and the second type of protruding connecting parts 26, 27. The peripheral rim surface 20 of the shell part 11 is shaped symmetrically about a vertically center axis, when in use. Two toy construction elements 1 comprises identically shaped periphery rim surfaces adapted to enclose an inner volume defined by two shell parts 11.

In the embodiments shown on the figures the peripheral rim surface 20 is substantially circular, but to the skilled person it would be possible to achieve the same functionality with other shapes of the peripheral rim, such as an egg shaped or an elliptical shape.

The upper and the lower cylindrical shaped protrusions 15,17 are positioned apart each other along the peripheral rim surface 20 in a distance corresponding to the size, such as the first length $L_1$ of the first type of cylindrical shape protrusion 16 or larger, such that the first cylindrical protrusion 16 is adapted to be releasably pivotably fixed between the upper and lower cylindrical shaped protrusions 15, 17.

The thru hole 18 of the first cylindrical shaped protrusion 16 and the thru holes 18 of the upper and the lower cylindrical shaped protrusions comprises the same cylindrical shape and cross sectional diameter. The thru holes 18 are adapted to allow a stud shaped toy construction element 19 to be passed through the thru holes to form a common rotation axis. The stud shaped toy construction element 19 may be removed to de-construct two connected toy construction elements 1', 1".

The center of the thru holes 18 and the stud shaped toy construction element 19 defines an axis of rotation H1 allowing two connected toy construction elements 1 to be rotated relative to each other. The rotation is controlled and ensures that the faces of the peripheral rim surface will abut when a capsule is formed.

The toy construction element 1 comprises a latch pin 19 or a toy construction stud element, which are adapted to be positioned through three successively positioned thru holes, allowing two or more/adjacent toy construction elements 1 to be pivotally connected.

The stud-shaped toy construction element 19 may be provided with a handle for easier removal when de-constructing the capsule.

One of the toy construction elements illustrated in FIG. 1 comprises a detachable capsule divider 30. The capsule divider 30 is shaped as a toy construction building plate and comprises a hinge portion 23, which is connected to the shell part 11. Hinge portion 23 has a second hinge axis H2.

The capsule divider 30 comprises an upper face comprising protruding coupling organs 33 positioned in grid points of a regular two-dimensional pattern, and a lower face comprising complementary coupling organs 32 positioned in grid points of the same regular two-dimensional pattern.

The hinge portion 23 is arranged such that its hinge axis, second hinge axis H2, is located in a plane parallel to the second plane, and in the first plane. In the figures the second hingeaxis is to be horizontal corresponding to the use condition, with the stand surface 14 parallel to the above mentioned horizontal plane. The hinge portion 23 is provided along an inner bottom face 21 of the inner surface 12. The inner bottom surface 21 is parallel to the stand surface 14 and the second plane. The hinge portion 23 is adapted to allow the capsule divider 30 to be moved from an substantially horizontal open position to a substantially vertical closed position within the cavity 50 of the toy construction element 1, 1". The capsule divider 30 may be positioned adjacent the first plane within the cavity 50, such when two toy construction elements 1 are coupled together by the first type of protruding connecting part 26 and the second protruding connecting part 27 to form a closed capsule. The capsule divider 30 will be arranged within the inner volume of the capsule, dividing the inner volume into two compartments.

The capsule divider 30 may comprise a recess 31 at the periphery as to allow a user to move the capsule divider from a closed position (where the plane-shaped capsule divider 30 is in a position substantially in the first plane) to an open position. In FIG. 1, the capsule divider 30 is shown in an open position. The recess 31 may be shaped and sized to allow a user, such as a child, to enter a finger of a finger tip into the recess 31, such that the capsule divider 30 may be pivoted towards the open position.

The bottom face 21 may be provided with a recess 22, which comprises protruding coupling organs, adapted to allow interconnecting with one or more different type of toy construction elements 40 comprising at least complementary coupling organs.

The toy construction element 1 may comprise a planar circular shaped upper surface element 13, and/or a planar circular shaped side surface element 34, both being part of the outer and/or inner surface of the shell part 11.

The planar circular shaped upper surface element 13 and the planar circular shaped side surface element 34 may comprise protruding coupling organs 33, which are positioned in grid points of a regular two-dimensional pattern.

The planar, circular shaped side surface element 34 extends in plane parallel to the first plane, and the planar circular shaped upper surface element 13 extends in a plane parallel to the second plane.

FIG. 2, in a perspective view, illustrates of a row 50 of interconnected shell part-shaped toy construction elements 1.

Each of the plurality of toy construction elements 1 illustrated in FIG. 2 comprises respectively the first type of protruding connecting parts 26 at the first position and on the opposite side of the periphery rim surface 20 at the second position each of the toy construction elements 1 comprises identically shaped the second type of protruding connecting parts 27. Thus any toy construction element 1 may be interconnected with any other toy construction element 1 comprising the protruding connecting parts 26,27.

In FIG. 2 a plurality of toy construction elements 1 are interconnected by respectively the first and second type of protruding parts 26, 27.

The first type of protruding connecting parts 26 comprises a first cylindrical shaped protrusion 16 comprising a thru hole 18. The thru hole 18 extends parallel with the first plane and perpendicular to the second plane.

The second type of protruding connecting part 27 comprises an upper and a lower cylindrical shaped protrusions 15, 17 each comprising a thru hole 18, and the two thru holes are positioned coaxially extending in a plane parallel with the first plane and perpendicular to the second plane.

Due to the identically shaped protruding connecting parts 26,27, the shell parts 11 of the toy construction elements 1 are oriented the same way relatively to each other.

The upper and the lower cylindrical shaped protrusions 15,17 are positioned apart each other vertically along the peripheral rim surface 20 in a distance corresponding to the size of the first cylindrical shape protrusion 16. The distance may be larger than the size of the first cylindrical shape protrusion 16 in the vertical direction. The first cylindrical protrusion 16 is adapted to be fixed between the upper and lower cylindrical shaped protrusions 15,17 in a releasably and pivotably manner by a pin or stud shaped toy construction element 19.

Generally, the toy construction element comprises a bowl shaped shell part 11, the shell part 11 comprises a cavity adapted to provide an inner volume.

Some of the toy construction elements illustrated in FIG. 2 comprise a hinge portion 23, the hinge portion 23 is connected to a capsule divider 30, which is adapted to respectively provide a toy construction building plate and to divide the inner volume of a capsule, which comprises two toy construction elements, into two compartments.

The toy construction element and the protruding connecting parts 26,27 is made from plastic material.

The invention further relates to a toy construction system comprising a plurality of toy construction elements, each toy construction elements comprises coupling organs for detachable interconnecting the toy construction elements, wherein the toy construction system comprises a plurality of toy construction elements 1 according to the present invention.

Generally, the toy construction elements comprise coupling studs and/or complementary shaped coupling skirts. The interconnection taking place in an axial direction of the coupling studs and/or the complementary shaped coupling skirts.

The present disclosure further relates to a computer-readable model comprising computer-readable instructions configured to cause, when processed by an apparatus for performing an additive manufacturing process, said apparatus to manufacture a toy construction element as disclosed herein. The computer-readable model may comprise geometry information indicative of at least the shape of the toy construction element. The computer-readable model may be embodied as a computer-readable medium having stored thereon a data structure representing the computer-readable model. For example, the computer-readable medium may include a hard disk, a memory, or another suitable storage device. The additive manufacturing process may include a 3D printing printing process.

The invention claimed is:

1. A toy construction element comprising a bowl shaped shell part having a peripheral rim surface, an inner face, a stand surface adapted for allowing the shell part to rest on a plane surface, and a first and a second type of protruding connecting parts, and where the shell part is configured such that two identical shell parts can be assembled by interconnecting the first type of protruding connecting parts on each shell part to the second type of protruding connecting parts on the other shell part, and so that their peripheral rim surfaces are mutually facing each other to form a substantially closed capsule with the inner faces enclosing an inner volume, characterized in that the first type of protruding connecting part and the second type of protruding connecting part are positioned adjacent the peripheral rim surface at opposite sides, and where each of the first type of protruding connecting part and the second type of protruding connecting part are adapted to mate and form a releasable and pivotable hinge connection with a hinge axis, and where the hinge axes defined by the first and the second type of protruding connecting parts are mutually parallel and defining a first plane, and where the stand surface extends in a second plane substantially perpendicular to the first plane, and where the peripheral rim surface extends in the first plane.

2. The toy construction element according to claim 1, wherein the first type of protruding connecting part comprises a first cylindrical shaped protrusion comprising a through hole, the through hole extending parallel with the first plane and perpendicular to the second plane.

3. The toy construction element according to claim 1, wherein the second type of protruding connecting part comprises an upper and a lower cylindrical shaped protrusion each comprising a through hole, and the two through holes are positioned coaxially extending in a plane parallel with the first plane.

4. The toy construction element according to claim 3, wherein the upper and the lower cylindrical shaped protrusions are positioned apart each other along the peripheral rim surface in a distance corresponding to the size of the first cylindrical shape protrusion or larger, such that the first cylindrical protrusion is adapted to be fixed between the upper and lower cylindrical shaped protrusions in a releasably and pivotably manner.

5. The toy construction element according to claim 3, wherein the through hole of a first cylindrical shaped protrusion and the through holes of the upper and the lower cylindrical shaped protrusions comprises the same cylindrical shape and cross sectional diameter, and wherein the through holes are configured to allow a stud shaped toy construction element to be passed through the through holes to form a common rotation axis.

6. The toy construction element according to claim 3, wherein the toy construction element comprises a latch pin or a stud-shaped toy construction element, which are adapted to be positioned through three successively positioned through holes, allowing two or more adjacent toy construction elements to be pivotally connected.

7. The toy construction element according to claim 1, wherein the toy construction element further comprises a detachable capsule divider, and where the capsule divider comprises a hinge portion, which is connected to the shell part.

8. The toy construction element according to claim 7, wherein the hinge portion is arranged along the peripheral rim surface at a bottom face of the inner surface, the hinge portion being adapted to allow the capsule divider to be moved from a substantially horizontal open position to a substantially vertical closed position within the inner volume defined by the inner surface of the toy construction element.

9. The toy construction element according to claim 1, wherein the toy construction element further comprising protruding coupling organs and complementary coupling organs adapting the toy construction elements to be interconnected with different types of toy construction elements comprising coupling organs, the protruding coupling organs and complementary coupling organs are positioned on an outer surface or/and an inner surface of the toy construction element.

10. The toy construction element according to claim 1, wherein the toy construction element is made from plastic material.

11. A toy construction system comprising a plurality of toy construction elements according to claim 1, where each toy construction element comprises coupling organs for detachable interconnecting other toy construction elements.

* * * * *